US005277563A

United States Patent [19]

Wen-Jen et al.

[11] Patent Number: 5,277,563

[45] Date of Patent: Jan. 11, 1994

[54] SCROLL COMPRESSOR WITH AXIAL SEALING APPARATUS

[75] Inventors: Kuo Wen-Jen; Tseng Wen-Ding; Yang Chih-Cheng; Chang Lung-Tsai, all of Hsinchu, Taiwan

[73] Assignee: Industrial Technology Research Institute, Taiwan

[21] Appl. No.: 926,522

[22] Filed: Aug. 10, 1992

[51] Int. Cl.[5] ..... F04C 18/04; F04C 27/00

[52] U.S. Cl. ..... 418/55.5; 418/57

[58] Field of Search ..... 418/55.5, 57

[56] References Cited

FOREIGN PATENT DOCUMENTS 2-191888 7/1990 Japan ..... 418/55.5

3-78586 4/1991 Japan ..... 418/55.5

*Primary Examiner*—John J. Vrablik

*Attorney, Agent, or Firm*—Michael D. Bednarek

[57] ABSTRACT

A scroll compressor has a stationary scroll member and an orbiting scroll member which moves around the stationary scroll member to consecutively compress working fluid. A piston is provided to urge the orbiting scroll member to come close to the stationary scroll member. The piston is driven to urge the orbiting scroll member by compressed working fluid which is guided to enter an annular chamber communicating with compressed working fluid or working fluid being compressed. By this arrangement, the mechanical efficiency of the scroll compressor will be enhanced, and mixing of working fluid and lubricant is able to be reduced. Furthermore, the wobbling of the orbiting scroll member will also be diminished.

14 Claims, 9 Drawing Sheets

SCROLL COMPRESSOR WITH AXIAL SEALING APPARATUS

FIELD OF THE INVENTION

The present invention relates to a scroll compressor with axial sealing apparatus, and more particularly to a scroll compressor with axial sealing apparatus capable of preventing the orbiting scroll member from being pushed away from the stationary scroll member by compressed working fluid.

BACKGROUND OF THE INVENTION

Scroll compressors are used in refrigeration systems such as refrigerators, freezers and air conditioners. As shown in FIGS. 1*a*–1*c*, a scroll compressor is always provided with a stationary scroll member 14 and an orbiting scroll member 18 which rotates around the center of the stationary scroll member 14. In other words, the orbiting scroll member 18 is orbiting round the center of the stationary scroll member 14. During operation, working fluid 3 to be compressed is guided to enter a space 19 enclosed by the stationary scroll member 14 and the orbiting scroll member 18 (see FIG. 1*a*), then the enclosed working fluid 3 is progressively compressed by the orbiting motion of the orbiting scroll member 18 and finally discharged from the scroll compressor by way of the discharge port 19*g* (see FIGS. 1*b* and 1*c*).

FIG. 2 is a cross sectional view showing the whole construction of a conventional scroll compressor 12 which has been disclosed in detail in U.S. Pat. No. 4,365,941.

When the orbiting scroll member 18 is driven to rotate about the axis of the stationary scroll member 14, the orbiting scroll member 18 is subjected to an axial force "F" shown in FIG. 2, which tends to push the orbiting scroll member 18 away from the stationary scroll member 14. If the axial force "F" cannot be overcome, the clearance between the orbiting scroll member 18 and the stationary scroll member 14 will be enlarged, and working fluid being compressed will leak through the enlarged clearance. Thus, the volumetric efficiency of the scroll compressor will be reduced.

Two ways have been proposed to overcome the tip surface leakage problem occurred in conventional scroll compressors.

First, U.S. Pat. No. 4,564,343 discloses a resilient sealing element. As shown in FIGS. 3 and 4, two resilient sealing elements 8 are embedded respectively into tip surfaces 7*a*, 7*b* of the scroll wraps 18*b*, 14*b* of the orbiting scroll member 18 and the stationary scroll member 14. By this arrangement, clearance formed between the tip surface 7*a* of the scroll wrap 18*b* and the end plate surface 14*s* of the stationary scroll member 14 as well as clearance formed between the tip surface 7*b* of the scroll wrap 14*b* of the stationary scroll member 14 and the end plate surface 18*s* of the orbiting scroll member 18 will be blocked, and leakage of working fluid to be compressed will be reduced.

However, resilient sealing elements 8 are embedded in the tip surfaces 7*a* and 7*b* of the scrolls 18*b* and 14*b*, and the width "w" of the resilient sealing elements 8 should be smaller than the thickness "t" of both scrolls wrap 14*b* and 18*b*. Thus, working fluid will still leak out along the peripheral direction "i" of the scroll. In addition, resilient sealing elements 8 will inevitably wear out, and leakage amount of working fluid will increase time by time.

FIG. 5 shows the second way used in U.S. Pat. No. 4,365,941 to overcome leakage problem. FIG. 5 is a fragmentary view of a scroll compressor with some minor modifications to the stationary scroll member 14 thereof. As shown in FIG. 5, two small through holes 18*d* are formed in the orbiting scroll member 18. These two holes 18*d* communicate the backpressure chamber 31 with the compression chambers 19*a* and 19*b*, thus the backpressure chamber 31 is maintained at the same pressure as that of compression chamber 19*a* and 19*b*. By this arrangement, a resultant forge "P" pushing the orbiting scroll member 18 upward at the center of geometry thereof will be induced, and the force "F" pushing the orbiting scroll member 18 away from the stationary scroll member 14 will be counteracted. Nevertheless, the resultant force "P" should be larger than the resultant force "F" by at least an amount that the orbiting scroll member 18 will not wobble due to a lateral resultant force "R" exerting on the scroll wrap 18*b* of the orbiting scroll member 18. For this reason, a large resultant force "P" is required, and thus the orbiting scroll member 18 suffers from a great frictional force. Consequently, mechanical efficiency of scroll compressors will thus be reduced. In addition, an undesirable mixing of the lubricant and the working fluid will inevitably arise due to that the lubricant enters the compression chambers by way of the holes 18*d*, and the volumetric efficiency of scroll compressors will be diminished.

SUMMARY OF THE INVENTION

An object of the present invention is to provide a scroll compressor with an axial sealing apparatus which is capable of enhancing mechanical efficiency of a scroll compressor.

Another object of the present invention is to provide a scroll compressor with an axial sealing apparatus which is capable of reducing mixing of working fluid and lubricant.

The above objects is achieved by a scroll compressor with an axial sealing apparatus, which comprises a casing; a stationary scroll member mounted within the casing in such a way that the stationary scroll member is unable to move relative to the casing for cooperating with the casing to form a first enclosed space therebetween, the stationary scroll member being provided with a first end plate surface and a first scroll wrap, the first scroll wrap being integrally formed with the stationary scroll member; a orbiting scroll member provided with a second end plate surface and a second scroll wrap on the second end plate surface, the second scroll wrap being integrally formed with the orbiting scroll member, the orbiting scroll member being engaged with the stationary scroll member on the opposite side of the first enclosed space formed between the casing and the stationary scroll member in such a way that the second scroll wrap meshes with the first scroll wrap to consecutively compress the working fluid enclosed in the first scroll wrap and the second scroll wrap and discharge the working fluid into the first enclosed space when the orbiting scroll member rotates around the stationary scroll member; a frame secured to the inner wall of the casing, for cooperating with the stationary scroll member to form a second enclosed space for accommodating the orbiting scroll member therewith; means for driving the orbiting scroll member to revolve around the stationary scroll member, having a drive shaft penetrating the frame and being engaged with the orbiting scroll member at one end of the driving shaft; and an annular piston disposed within the second enclosed space and movably fitted into the annular groove of the frame in such a way that the annular piston is capable of being slid along the longitudinal axis of the drive shaft of the driving means, the annular piston being able to urge the orbiting scroll member to come close to the stationary scroll member when the annular piston is guided to move in the direction toward the orbiting scroll member, and the annular piston cooperating with the annular groove of the frame to form an annular chamber on the other side far away from the orbiting scroll member, the annular chamber being communicated with a predetermined portion of the stationary scroll member by way of a passage passing through the frame and a location of the first end plate surface of the stationary scroll member, the predetermined portion being selected in such a way that the predetermined portion cooperates with the first scroll wrap and the second scroll wrap to compress working fluid during consecutive compression of working fluid so as to guide compressed working fluid into the annular chamber to urge the annular piston to move toward the orbiting scroll member.

The above objects may also be achieved by a scroll compressor with an axial sealing apparatus, according to the second embodiment of the present invention, comprises a casing; a stationary scroll member fixed in such a way that the stationary scroll member is unable to move relative to the casing for cooperating with the casing to form a first enclosed space therebetween, the stationary scroll member being provided with a first end plate surface and a first scroll wrap on the first end plate surface, the first scroll wrap being integrally formed with the stationary scroll member; an orbiting scroll member provided with a second end plate surface and a second scroll wrap on the second end plate surface, the second scroll wrap being integrally formed with the orbiting scroll member, the orbiting scroll member being engaged with the stationary scroll member on the opposite side of the first enclosed space formed between the casing and the stationary scroll member in such a way that the second scroll wrap meshes with the first scroll wrap to consecutively compress the working fluid enclosed in the first scroll wrap and the second scroll wrap and discharge the working fluid into the first enclosed space when the orbiting scroll member rotates around the stationary scroll member; a frame secured to the inner wall of the casing, for cooperating with the stationary scroll member to form a second enclosed space for accommodating the orbiting scroll member therewith; means for driving the orbiting scroll member to rotate around the stationary scroll member, having a drive shaft penetrating the frame and being engaged with the orbiting scroll member at one end of the drive shaft; and an annular piston disposed within the second enclosed space and movably fitted into said annular groove of the frame in such a way that the annular piston is capable of being slid along the longitudinal axis of the drive shaft of the driving means, the annular piston being able to urge the orbiting scroll member to come close to the stationary scroll member when the annular piston is guided in the annular groove of the frame to move in the direction toward the orbiting scroll member, and the annular piston cooperating with the frame to form an annular chamber on the other side far away from the orbiting scroll member, the annular chamber being communicated with the first enclosed space by way of a passage passing through the frame and the stationary scroll member.

BRIEF DESCRIPTION OF THE DRAWINGS

The above and other features and advantages of the present invention will become more apparent from reading the following description of the preferred embodiments taken in connection with the accompanying drawings in which.

DETAILED DESCRIPTION OF THE PREFERRED EMBODIMENTS

Figure 6:
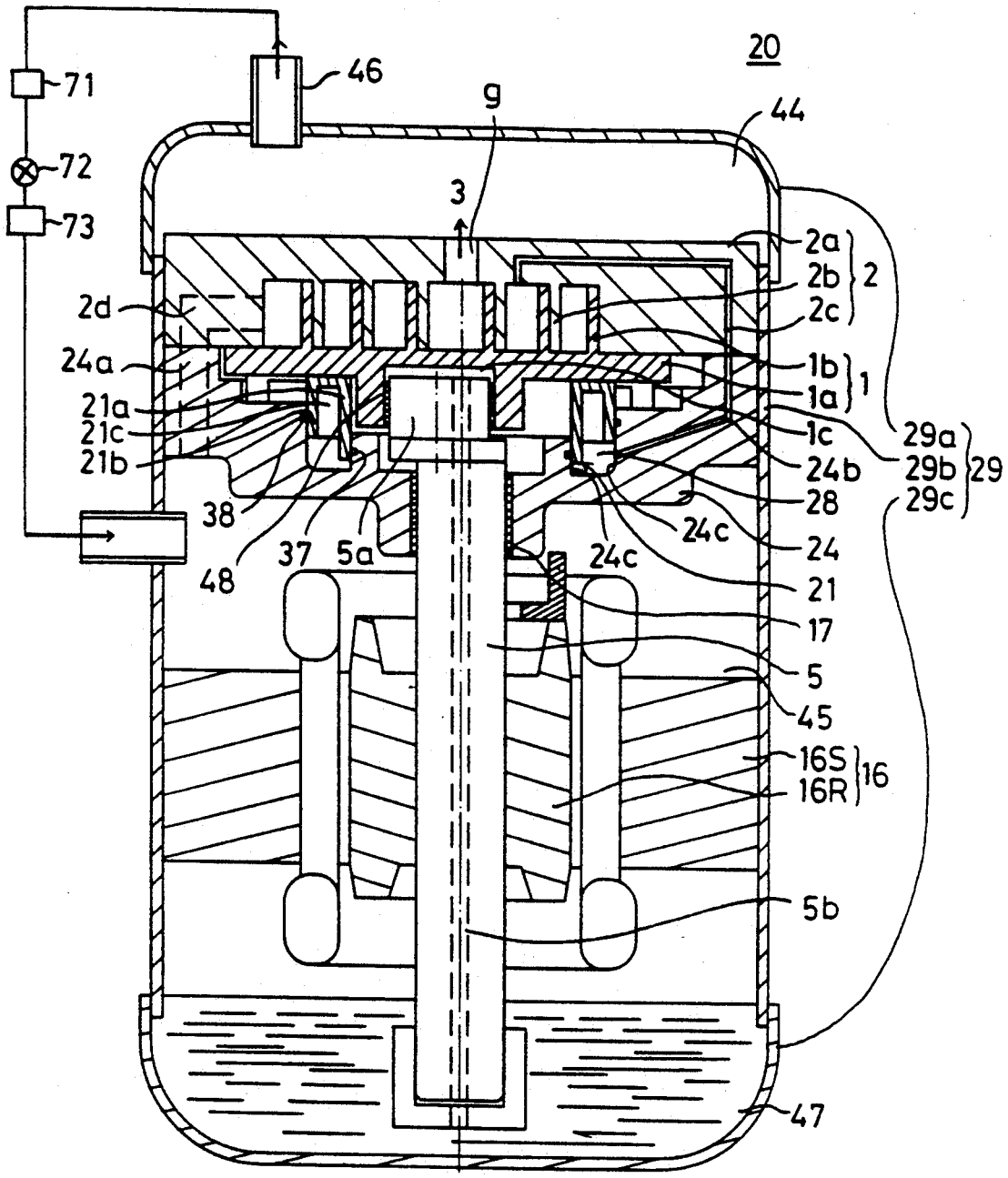
FIG. 6 is a cross-sectional view showing the whole construction of a scroll compressor equipped with the first embodiment of axial sealing apparatus according to the present invention.

With reference to FIG. 6, a scroll compressor 20 equipped with an axial sealing apparatus according to the present invention primarily comprises an orbiting scroll member 1, a stationary scroll member 2, an annular piston 21, a motor 16, a crankshaft 5, a frame 24, and a casing 29. The casing 29 includes an upper casing member 29*a*, a middle casing member 29*b*, and a lower casing member 29*c*.

The stationary scroll member 2 comprises a first end plate 2*a*having a discharge port "g" formed at the center thereof, and a first scroll wrap 2*b* extending in a direction perpendicular to the first end plate 2*a*. A passage 2*c* is extended into a portion of the stationary scroll member 2. A suction passage 2*d* is formed in the peripheral wall of the stationary scroll member 2. The stationary scroll member 2 is mounted within the middle casing member 29*b*, and a first enclosed space 44 is confined by the upper casing member 29*a* and the stationary scroll member 2.

The first enclosed space 44 is communicated with refrigeration system, which consists of a condenser 71, an expansion valve 72 and an evaporator, through a discharge pipe 46 passing through the upper casing member 29*a*.

The orbiting scroll member 1 comprises a second end plate 1*a* and a second scroll wrap 1*b* extending in the direction perpendicular to the second end plate 1*a*. A coupling recess 1*c* is formed on the undersurface of the second end plate 1*a*.

During operation, the first scroll wrap and second scroll wrap 2*b* and 1*b* of the stationary scroll member 2 and the orbiting scroll member 1 are meshed with each other to compress working fluid in a consecutive way and discharges compressed working fluid into the first enclosed space 44.

The frame 24 is provided with a suction passage 24*a*, a passage 24*b*, and an annular groove 24*c*. The passage 24*b* communicates with the passage 2*c* of the stationary scroll member 2. The frame 24 is secured to the stationary scroll member 2.

Figure 7:
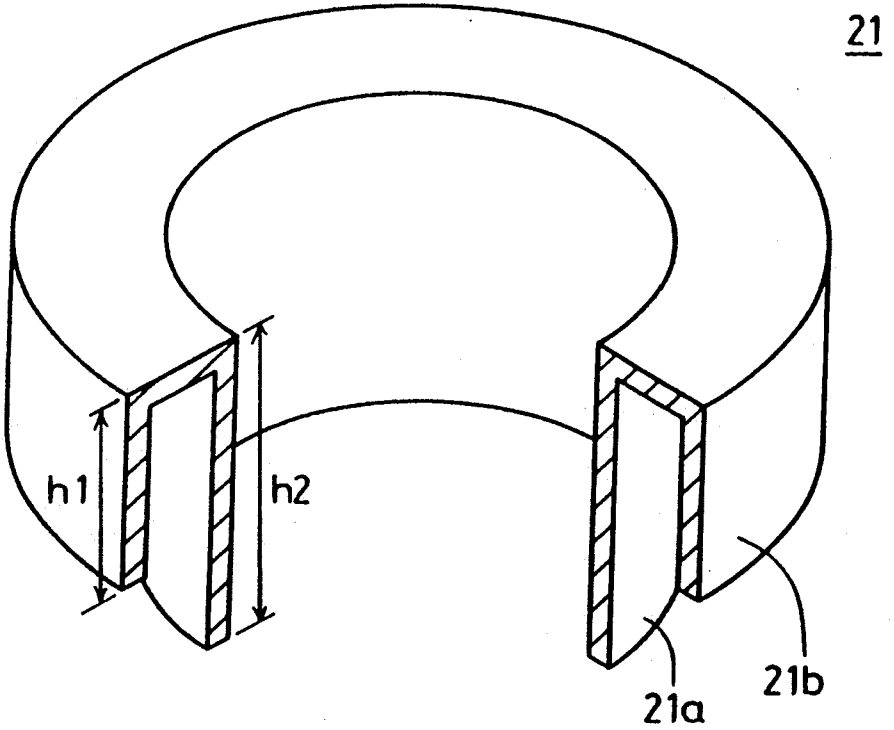
FIG. 7 is a perspective view showing the construction of the annular piston 21 of the scroll compressor shown in FIG. 6.
Figure 8:
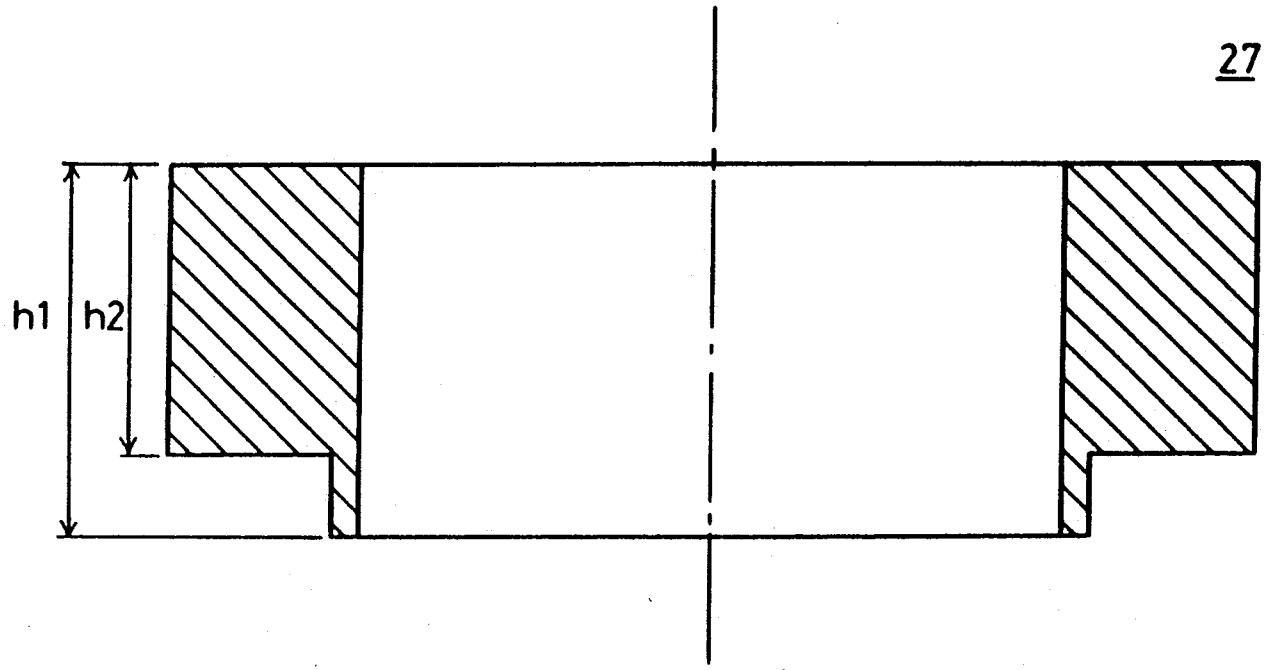
FIG. 8 is a cross-sectional view showing another type of the annular piston used in an embodiment of axial sealing apparatus according to the present invention.

The annular piston 21 has an inner ring 21*a*, an outer ring 21*b*, and an annular groove 21*c* as best shown in FIG. 7. The height h2 of the outer ring 21*b* is smaller than the height h1 of the inner ring 21*a*. By this arrangement, working fluid is capable of being guided to enter an annular chamber 28 confined by the annular piston 21 and the frame 24. FIG. 8 shows another type of annular piston 27 whose shape is similar to that of the annular piston 21 except that no annular groove 21*c* is formed therein.

The annular piston 21 is movably fitted into the annular groove 24*c* defined by the inner guide ring 24*e* and outer guide ring 24*f* of the frame 24 in such a way that the annular piston 21 is capable of being slid in the annular groove 24*c* of the frame 24 along the longitudinal axis of the scroll compressor 20. A first sealing ring 37 and a second sealing ring 38 are embedded respectively on the outer guide ring 24*f* in contact with inner guide ring 24*e* in contact with the inner ring 21*a* and outer guide ring 24*f* in contact with the outer ring 21*b* of the annular piston 21. Alternatively, sealing rings 37 and 38 are able to be provided to the inner ring 21*a* in contact with the inner guide ring 24*e* and the outer ring 21*b* in close contact with the other guide ring 24*f* respectively.

The crankshaft 5 penetrates a bearing 17 mounted on the frame 24, and a boss 5*a* is formed at the upper end of the crankshaft 5. The axis of the boss 5*a* is eccentric to the axis of the crankshaft 5. The boss 5*a* is fitted into a bush 48 mounted in the coupling recess 1*c* of the orbiting scroll member 1. The crankshaft 5 is provided with an oil passage 5*b* extending coaxially therewithin. The stator 16S of the motor 16 is secured to the inner wall of the middle casing member 29*b*, and the crankshaft 5 is securely mounted into the rotor 16R of the motor 16.

A second enclosed space 45 confined between the frame 24 and the stator 16*s* is communicated with the evaporator 73 through a suction pipe 30 extending through the wall of the middle casing member 29*b*.

The lower casing member 29*c* is used as a reservoir of lubricant 47. During operation, lubricant 47 is pumped upward by an oil pump (not shown) by way of the oil passage 5*b* to lubricate the working surface between the boss 5*a* and the orbiting scroll member 1, the working surface between the inner ring 21*a* of the annular piston 21 and the frame 24, the working surface between the crankshaft 5 and the frame 24, and the working surface between the outer ring 21*b* of the annular piston 21 and the frame 24.

Figure 1C:
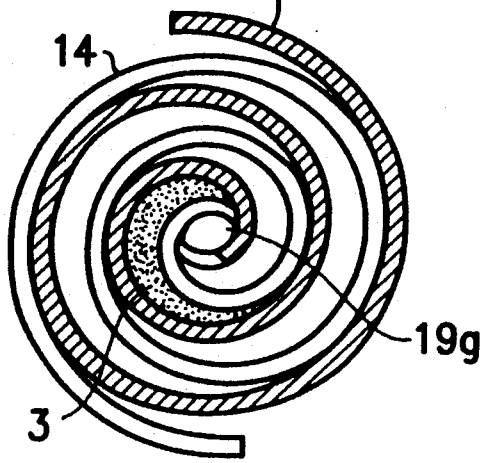
FIGS. 1*a*, 1*b*, and 1*c* are schematic diagrams showing consecutive motions of two scroll wraps in scroll compressors during operation.
Figure 1B:
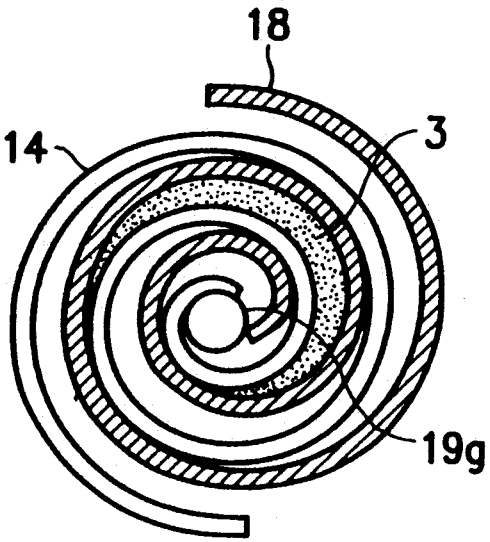
Figure 1A:
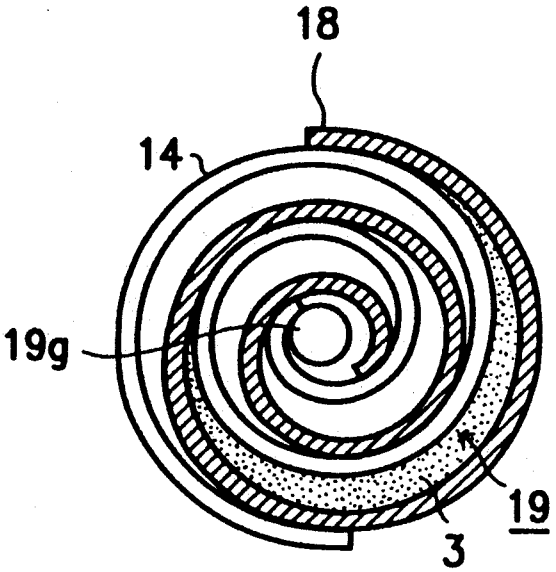
Figure 2:
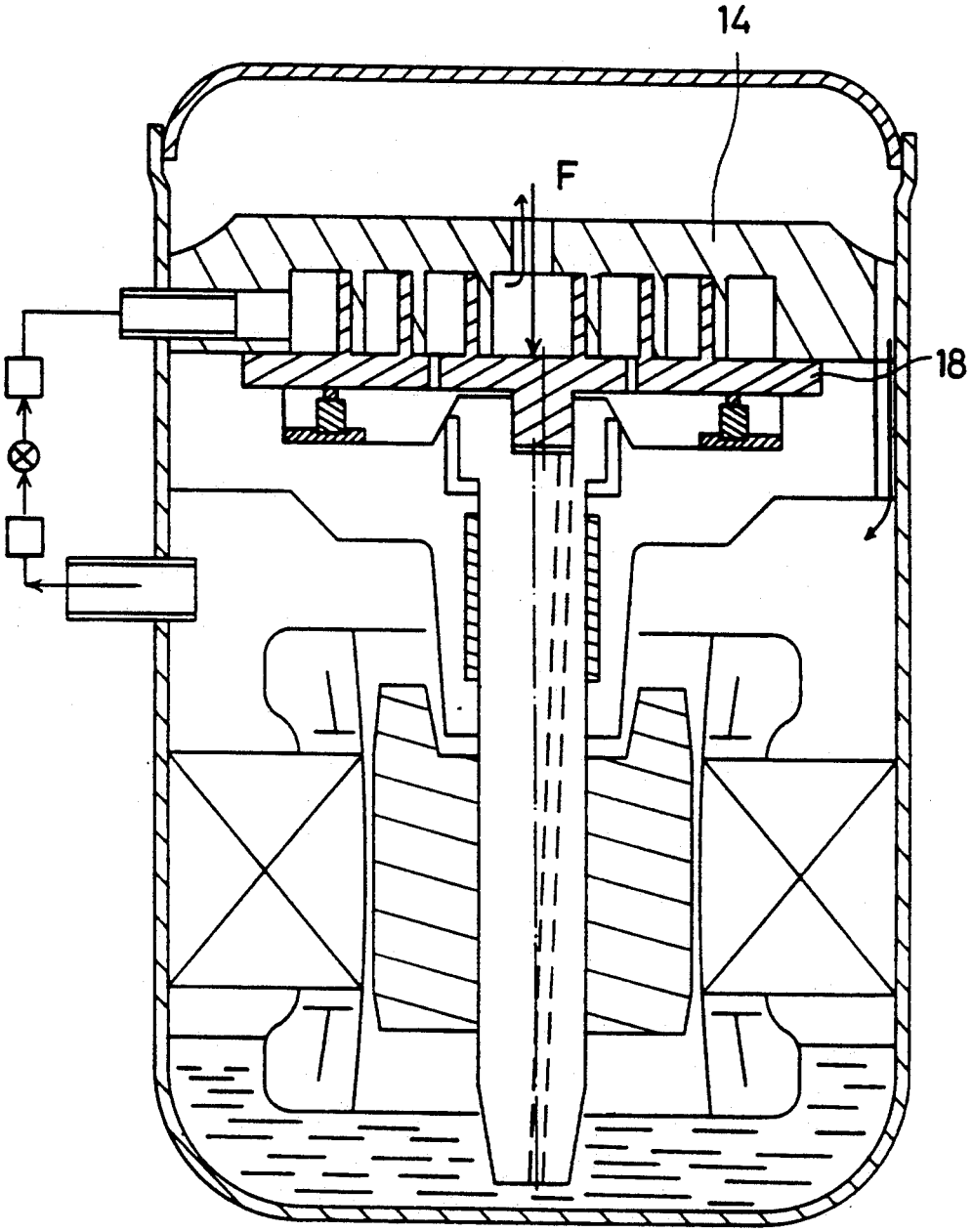
FIG. 2(PRIOR ART)
FIG. 2 is a cross-sectional view showing the whole construction of a conventional scroll compressor.
Figure 3:
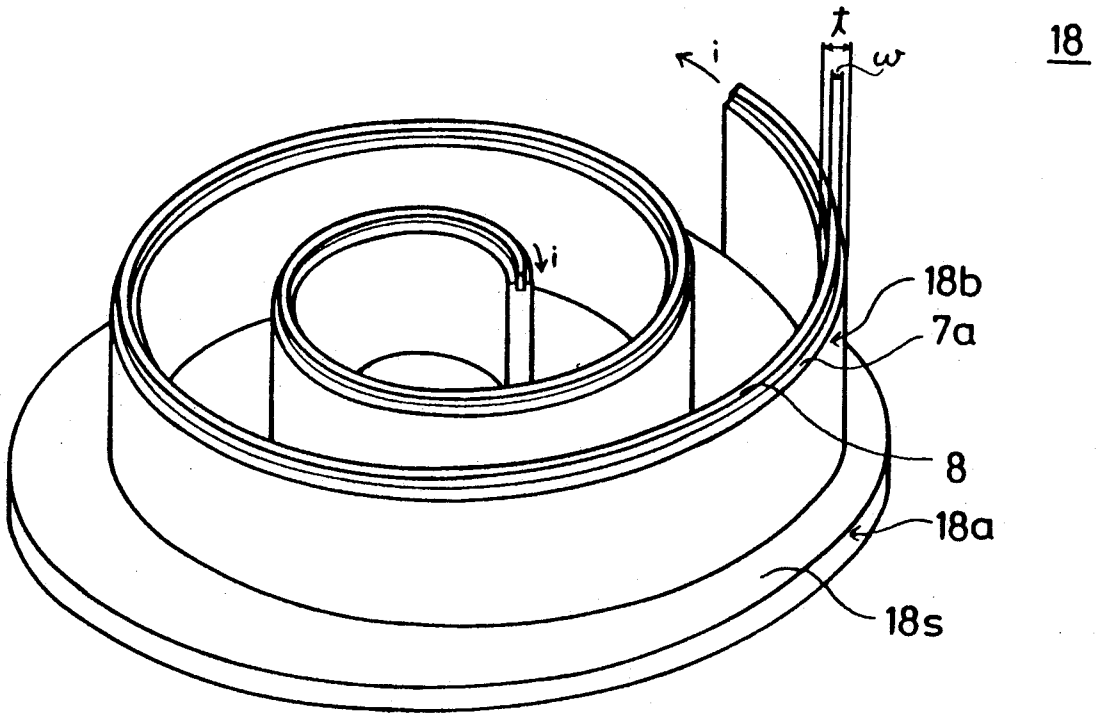
FIG. 3(PRIOR ART)
FIG. 3 is a perspective view showing a scroll member of a conventional scroll compressor with a resilient sealing element embedded in the scroll wrap of the scroll members.
Figure 4:
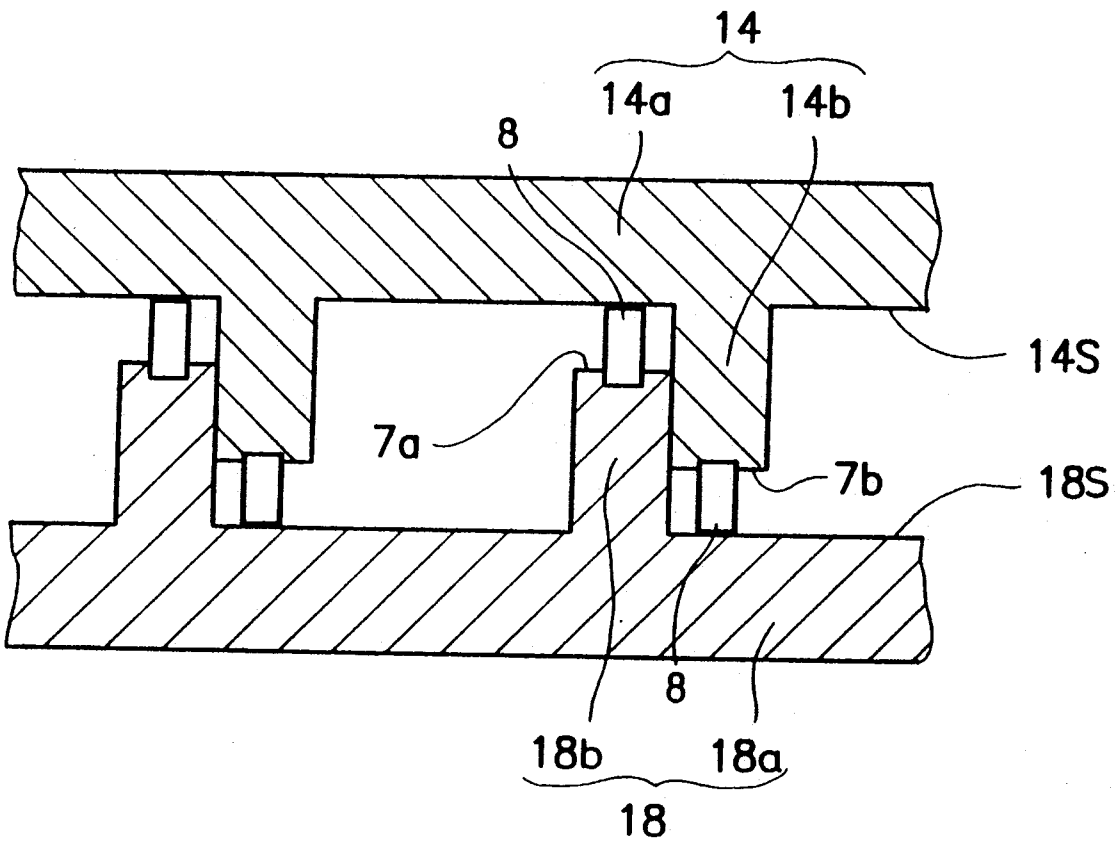
FIG. 4(PRIOR ART)
FIG. 4 is a cross-sectional view showing that a stationary scroll member and an orbiting scroll member are assembled together with resilient element embedded therein.

During operation, the orbiting scroll member 1 is driven to rotate by the crank shaft 5 of the motor 16, and working fluid will be sucked into a chamber confined by the scrolls wrap 1*b* and 2*b* by way of the suction pipe 30, the suction passage 24*a* of the orbiting scroll member 1 and the suction passage 2*d* of the stationary scroll member 2. Then, working fluid is consecutively compressed in the manner as described above (see FIGS. 1*a*, 1*b* and 1*c*). After being compressed, working fluid is discharged into the first enclosed space 44 through the discharge port "g", and then compressed working fluid is guided to enter into the condenser 71 through the discharge pipe 46. However, a portion of compressed working fluid enters the annular chamber 28 by way of the passages 2*c* and 24*b*. The bypassed intermediate pressure working fluid will push the annular piston 21 to move upward and urge the orbiting scroll member 1 to exert an upward force on the stationary scroll member 2. Due to the upward force induced by the bypassed intermediate pressure working fluid, the orbiting scroll member 1 and the stationary scroll member 2 will be urged to come together, and the tip surface leakage of working fluid being compressed will thus be reduced. Furthermore, due to the existence of the sealing rings 37 and 38, lubricant coming from the lower casing member 29*c* will not enter the space enclosed by the stationary scroll member 2 and the orbiting scroll member 1. Thus mixing of lubricant 47 and working fluid will be reduced.

Figure 5:
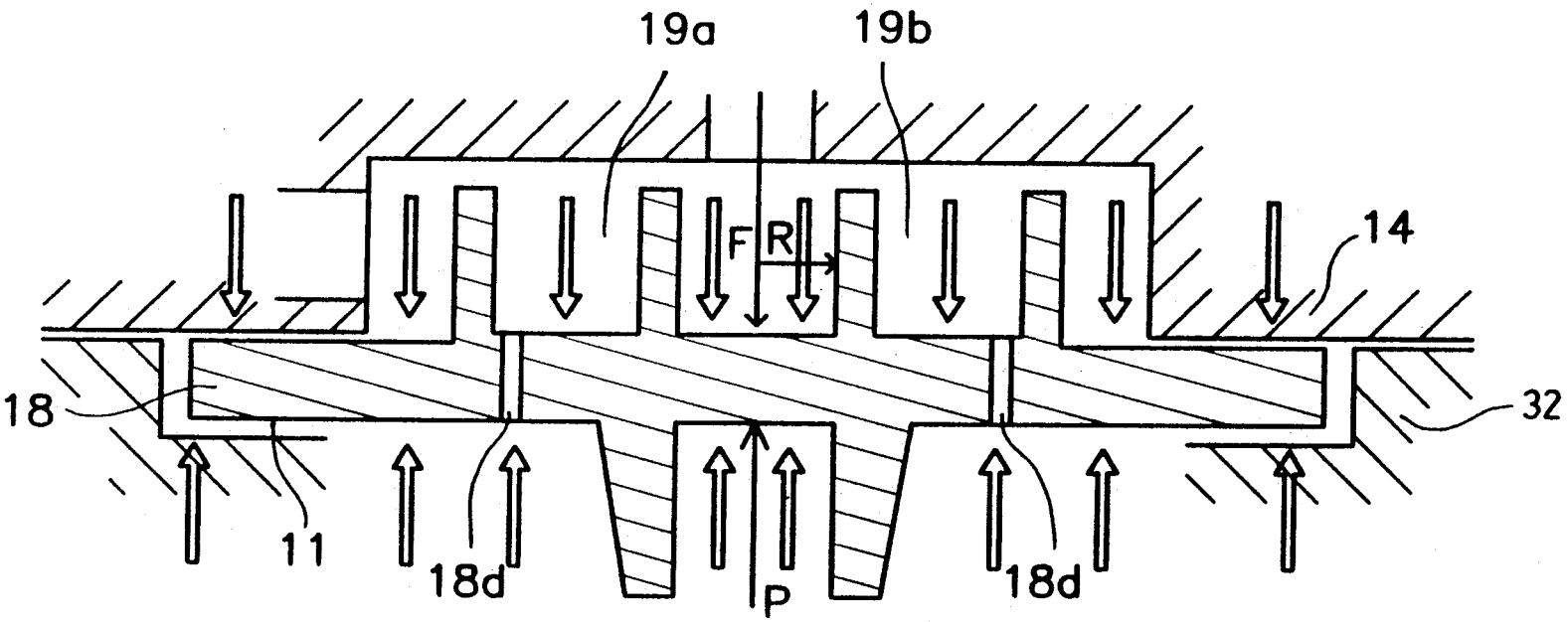
FIG. 5(PRIOR ART)
FIG. 5 is a fragmentary cross-sectional view showing that two through holes are formed in an orbiting scroll member to counteract compression pressure which tends to push two scroll members apart.
Figure 9:
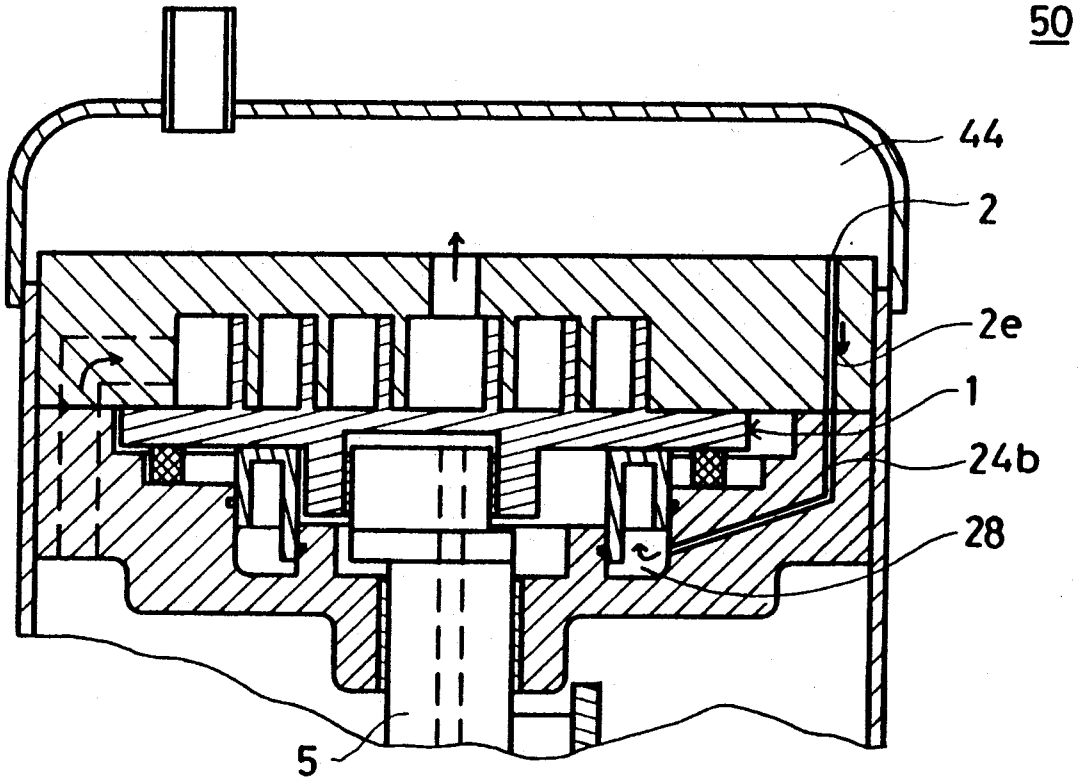
FIG. 9 is a fragmentary cross-sectional view showing the construction of another embodiment of axial sealing apparatus according to the present invention.

FIG. 9 shows a scroll compressor 50 equipped with a second embodiment of axial sealing apparatus according to the present invention. The scroll compressor 50 is similar to the scroll compressor 20 shown in FIG. 5 in structure except that the passage 2*c* formed in stationary scroll member 2 is replaced by a passage 2*e* which communicates the first enclosed space 44 and the passage 24*b* of the frame 24. By this arrangement, working fluid compressed to a high pressure will be guided to the annular chamber 28, and produce an upward force to urge the orbiting scroll member 1 to approach the stationary scroll member 2.

FIG. 8 shows another type of the annular piston 27 capable of replacing the annular piston 21.

The annular pistons 21 and 27 are designed in such a way that the bypassed compressed working fluid is still able to enter the annular chamber 28 even though the annular piston 21 or 27 is at its lowest position where the lower end of the inner ring 21*a* of the annular piston 21 touches the frame 24. The difference between the annular piston 21 and 27 is the annular piston 21 is lighter in weight than the annular piston 27 for the same material.

As an important feature of the present invention, the annular pistons 21 and 27 are designed such that the contact position between the orbiting scroll member 1 and the annular piston 21 is located at the outer rim of the annular piston so as to obtain a longer arm. Thus, the wobbling of the orbiting scroll member can be easily overcome by the annular pistons 21 and 27 of the present invention. Accordingly, tip surface leakage of the working fluid through the clearance between the tip surface of the orbiting scroll member and the first end plate surface of the stationary scroll member as well as well as between the tip surface of the stationary scroll member and the second end plate surface of the orbiting scroll member is substantially eliminated by the use of the annular piston of this invention, and the mixing of the lubricant and the compressed working fluid is greatly diminished. Therefore, the volumetric efficiency of the scroll compressor will be enhanced.

Although the present invention has been described in its preferred form with a certain degree of specificity, it is understood that the present disclosure of the preferred form has been changed in the details of construction, and recombination and arrangement of parts may be resorted to without departing from the spirit and the scope of the present invention as hereinafter claimed.

What is claimed is:

1. A compressor with axial sealing apparatus, for compressing working fluid in a consecutive manner, comprising:

a casing;

a stationary scroll member mounted within said casing in such a way that said stationary scroll member is unable to move relative to said casing for cooperating with said casing to form a first enclosed space therebetween, said stationary scroll member being provided with a first end plate and a first scroll wrap on said first end plate surface, said first scroll wrap being integrally formed with said stationary scroll member;

an orbiting scroll member provided with a second end plate surface and a second scroll wrap on said second end plate surface, said second scroll wrap being intergrally formed with said orbiting scroll member, said orbiting scroll member being engaged with said stationary scroll member on the opposite side of the first enclosed space formed between said casing and said stationary scroll member in such a way that the second scroll wrap meshes with the first scroll wrap to consecutively compress the working fluid enclosed in the first scroll wrap and the second scroll wrap and discharge the working fluid into said first enclosed space when said orbiting scroll member rotates around said stationary scroll member;

a frame secured to the inner wall of said casing, for cooperating with said stationary scroll member to form a second enclosed space for accommodating said orbiting scroll member therewith;

means for driving said orbiting scroll member to revolve around said stationary scroll member, having a drive shaft penetrating said frame and being engaged with said orbiting scroll member at one end of said drive shaft; and an annular piston disposed within said second enclosed space and sleeved around said drive shaft of said driving means in such a way that the annular piston is capable of being slid along the longitudinal axis of said drive shaft of said driving means, said annular piston being able to urge said orbiting scroll member toward said stationary scroll member when said annular piston is guided to move in the direction toward said orbiting scroll member, and said annular piston cooperating with said frame to form an annular chamber on the other side far away from said orbiting scroll member, said annular chamber having opposed end walls including a bottom wall, and the annular chamber further including a radially inner wall extending transversely from the bottom wall and a radially outer wall extending transversely from the bottom wall; said annular chamber being communicated with a predetermined portion of said stationary scroll member by way of a single passage passing through said frame and said stationary scroll member and having a first end at an opening into the radially outer wall of the annular chamber and a second end opening into the predetermined portion of the stationary scroll member, said predetermined portion being selected in such a way that said predetermined portion cooperates with the first scroll wrap and the second scroll wrap to compress working fluid during consecutive compression of working fluid so as to guide compressed working fluid into said annular chamber to urge said annular piston to move toward said orbiting scroll member.

2. A scroll compressor with axial sealing apparatus as claimed in claim 1, wherein said annular chamber enclosed by said annular piston and said frame is formed by slidably disposing said annular piston into a recess formed in said frame, said annular piston being capable of moving toward and away from said frame within a predetermined range of movement and wherein the inner and outer walls of the piston are in contact with the inner and outer walls of the chamber respectively throughout the predetermined range of movement such that the annular chamber remains enclosed.

3. A scroll compressor with axial sealing apparatus as claimed in claim 1, wherein the annular piston comprises a planar piston head having a radially inner edge and a radially outer edge; a radially inner wall extending transversely from the radially inner edge of the planar piston head, the radially inner wall having a predetermined height; and a radially outer wall extending transversely from the radially outer edge of the planar piston head, the radially outer wall having a predetermined height; the radially outer wall of the piston being in sliding contact with the radially outer wall of the annular chamber and the radially inner wall the piston being in sliding contact with the radially inner wall of the annular chamber and wherein the height of radially inner wall is greater than the height of the radially outer wall by a predetermined amount such that when the radially inner wall contacts the bottom wall of the annular chamber the passage formed in the radially outer wall of the annular chamber is not covered by the radially outer wall of the piston.

4. A scroll compressor with axial sealing apparatus as claimed in claim 3, wherein the annular piston further comprises an annular groove bounded by the piston head, the radially inner wall and the radially outer wall.

5. A scroll compressor with axial sealing apparatus as claimed in claim 1, wherein the single passage includes an inclined portion immediately adjacent the opening into the radially outer wall, the inclined portion being inclined with respect to both the bottom wall of the annular chamber and the radially outer wall such that compressed fluid enters the chamber from the passage at an angle directed from the opening in the radially outer wall toward the bottom wall.

6. A compressor with axial sealing apparatus, for compressing working fluid in a consecutive manner, comprising:

a casing;

a stationary scroll member mounted within said casing in such a way that said stationary scroll member is unable to move relative to said casing for cooperating with said casing to form a first enclosed space therebetween, said stationary scroll member being provided with a first end plate surface and a first scroll wrap on said first end plate surface, said first scroll wrap being integrally formed with said stationary scroll member;

an orbiting scroll member provided with a second end plate surface and a second scroll wrap on said second end plate surface, said second scroll wrap integrally formed with said orbiting scroll member, said orbiting scroll member being engaged with said stationary scroll member on the opposite side of the enclosed space formed between said casing and said stationary scroll member in such a way that the second scroll wrap meshes with the first scroll wrap to consecutively compress the working fluid enclosed in the first scroll wrap and the second scroll wrap and discharge the working fluid into said first enclosed space when said orbiting scroll member rotates around said stationary scroll member;

a frame secured to the inner wall of said casing, for cooperating with said stationary scroll member for form a second enclosed space for accommodating said orbiting scroll member therewith;

means for driving said orbiting scroll member to rotate around said stationary scroll member, having a drive shaft penetrating said frame and being engaged with said orbiting scroll member at one end of said drive shaft; and an annular piston disposed within said second enclosed space and sleeved around said drive shaft of said driving means in such a way that the annular piston being able to urge said orbiting scroll member toward said stationary scroll member when said annular piston is guided to move in the direction toward said orbiting scroll member, and said annular piston cooperating with said frame to form an annular chamber on the other side far away from said orbiting scroll member, said annular chamber being bounded by a bottom wall formed in the frame, the annular piston and two radially spaced side walls extending transversely from the bottom wall and including a radially inner wall and a radially outer wall said annular chamber being communicated with said first enclosed space by way of a single passage passing through said frame and said stationary scroll member, the single passage having a first end opening into the radially outer wall of the annular chamber and a second end opening directly into the first enclosed space so as to guide compressed working fluid into said annular chamber to urge said annular piston to move toward said orbiting scroll member.

7. A scroll compressor with axial sealing apparatus as claimed in claim 6, wherein said annular chamber enclosed by said annular piston and said frame is formed by slidably disposing said annular piston into a recess formed in said frame, said annular piston being capable of moving toward and away from said frame within a predetermined range of movement and wherein the inner and outer walls of the piston are in contact with the inner and outer walls of the chamber respectively throughout the predetermined range of movement such that the annular chamber is always bounded by the piston and frame.

8. A scroll compressor with axial sealing apparatus as claimed in claim 6, wherein the annular piston comprises a planar piston head having a radially inner edge and a radially outer edge; a radially inner wall extending transversely from the radially inner edge of the planar piston head, the radially inner wall having a predetermined height; and a radially outer wall extending transversely from the radially outer edge of the planar piston head, the radially outer wall having a predetermined height;

the radially outer wall of the piston being in sliding contact with the radially outer wall of the annular chamber and the radially inner wall the piston being in sliding contact with the radially inner wall of the annular chamber and wherein the height of radially inner wall is greater than the height of the radially outer wall by a predetermined amount such that when the radially inner wall contacts the bottom wall of the annular chamber the passage formed in the radially outer wall of the annular chamber is not covered by the radially outer wall of the piston.

9. A scroll compressor with axial sealing apparatus as claimed in claim 8, wherein the annular piston further comprises an annular groove bounded by the piston head, the radially inner wall and the radially outer wall.

10. A scroll compressor with axial sealing apparatus as claimed in claim 6, wherein the single passage includes an inclined portion immediately adjacent the opening into the radially outer wall, the inclined portion being inclined with respect to both the bottom wall of the annular chamber and the radially outer wall such that compressed fluid enters the chamber from the passage at an angle directed from the opening in the radially outer wall toward the bottom wall.

11. A compressor with axial sealing apparatus, for compressing working fluid in a consecutive manner, comprising:

a casing;

a stationary scroll member mounted within said casing in such a way that said stationary scroll member is unable to move relative to said casing for cooperating with said casing to form a first enclosed space therebetween, said stationary scroll member being provided with a first end plate surface and a first scroll wrap on said first end plate surface, said first scroll wrap being integrally formed with said stationary scroll member;

an orbiting scroll member provided with a second end plate surface and a second scroll wrap on said second end plate surface, said second scroll wrap being integrally formed with said orbiting scroll member, said orbiting scroll member being engaged with said stationary scroll member on the opposite side of the first enclosed space formed between said casing and said stationary scroll member in such a way that the second scroll wrap meshes with the first scroll wrap to consecutively compress the working fluid enclosed in the first scroll wrap and the second scroll wrap and discharge the compressed fluid into said first enclosed space when said orbiting scroll member rotates around said stationary scroll member;

a frame secured to the inner wall of said casing, for cooperating with said stationary scroll member to form a second enclosed space for accommodating said orbiting scroll member therewith;

means for driving said orbiting scroll member to revolve around said stationary scroll member, having a drive shaft penetrating said frame and being engaged with said orbiting scroll member at one end of said drive shaft; and an annular piston disposed within said second enclosed space and mounted on said drive shaft of said driving means such that the annular piston can be slid along the longitudinal axis of said drive shaft of said driving means, said annular piston being able to urge said orbiting scroll member toward said stationary scroll member when said annular piston is guided to move toward said orbiting scroll member, and said annular piston cooperating with said frame to form an annular chamber which is separated from the second enclosed space by the piston and spaced from said orbiting scroll member, said annular chamber being bounded by the annular piston, a bottom wall formed in the frame and two radially spaced side walls extending transversely from the bottom wall and including a radially inner wall and a radially outer wall, said annular chamber being communicated with a supply of compressed working fluid by way of a passage passing through said frame and said stationary scroll member, the passage having one end formed at an opening in the radially outer wall of the annular chamber and the passage being inclined such that compressed working fluid entering the annular chamber through the passage is directed away from the piston so as to guide compressed working fluid into said annular chamber to urge said annular piston to move toward said orbiting scroll member.

12. The scroll compressor of claim 11, wherein the annular piston comprises a planar piston head having a radially inner edge and a radially outer edge; a radially inner edge wall extending transversely from the radially inner edge of the planar piston head, the radially inner wall having a predetermined height; and a radially outer wall extending transversely from the radially outer edge of the planar piston head, the radially outer wall having a predetermined height;

the radially outer wall of the piston being in sliding contact with the radially outer wall of the annular chamber and the radially inner wall the piston being in sliding contact with the radially inner wall of the annular chamber and wherein the height of radially inner wall is greater than the height of the radially wall by a predetermined amount such that when the radially inner wall contacts the bottom wall of the annular chamber the passage formed in the radially outer wall of the annular chamber is not covered by the radially outer wall of the piston.

13. The scroll compressor of claim 12, wherein the annular piston further comprises an annular groove bounded by the piston head, the radially inner wall and the radially outer wall.

14. The scroll compressor of claim 11, wherein one and only one passage provides communication between the supply of compressed working fluid and the annular chamber.

* * * * *